United States Patent [19]

Schwartz

[11] 4,069,567

[45] Jan. 24, 1978

[54] METHOD OF INSTALLING A COLOR SELECTION ELECTRODE IN A COLOR CATHODE RAY TUBE

[75] Inventor: James W. Schwartz, Deerfield, Ill.

[73] Assignee: Zenith Radio Corporation, Glenview, Ill.

[21] Appl. No.: 772,406

[22] Filed: Feb. 28, 1977

[51] Int. Cl.[2] ..... H01J 9/18

[52] U.S. Cl. ..... 29/25.15; 29/447

[58] Field of Search ..... 29/25.15, 446, 447, 29/448

[56] References Cited

U.S. PATENT DOCUMENTS

| | | | |
|---|---|---|---|
| 2,654,940 | 10/1953 | Law | 29/447 X |
| 3,704,511 | 12/1972 | Hooker | 29/447 X |

*Primary Examiner*—Richard B. Lazarus
*Attorney, Agent, or Firm*—John H. Coult

[57] ABSTRACT

This disclosure depicts a method useful in the manufacture of a color cathode ray tube of the type having a phosphor screen and spaced therefrom a tensed color selection electrode. The method is a method of installing the electrode such that under normal tube operating conditions, the electrode is held by a holder in a hypertensed state and is thus capable of withstanding an unusually high electron beam bombardment before relaxing. In a preferred execution the method comprises selecting for the electrode a material which has a significantly higher coefficient of thermal expansion than that of the holder. The electrode and the holder are externally heated together, as by an oven, while the electrode is tensed. Simultaneously therewith, a selective auxiliary heating of the electrode is expected, as by passing an electrical current through the electrode, or by RF heating, such that the holder is heated to a predetermined first elevated temperature significantly greater than the first temperature, the holder and electrode thus being caused to thermally expand, but the electrode by a greater amount. The electrode is affixed to the holder. Finally, the electrode and holder are cooled to room temperature so as to hypertense the electrode due to the greater coefficient of thermal expansion and temperature fall of the electrode than the holder.

4 Claims, 1 Drawing Figure

METHOD OF INSTALLING A COLOR SELECTION ELECTRODE IN A COLOR CATHODE RAY TUBE

BACKGROUND OF THE INVENTION

This invention concerns the manufacture of color cathode ray tubes, and in particular the manufacture of color cathode ray tubes of the types which employ a tensed color selection electrode. A variety of color cathode ray tubes in the prior art have a phosphor screen, adjacent to which is a color selection electrode which controls the landing pattern of one or more electron beams as they are swept across the screen to trace out a television picture. Some of these tubes disclosed in the prior art employ a tensed color selection electrode — others a non-tensed electrode. The most common type of color selection electrode in commercial use today is of the non-tensed type and is the so-called "shadow mask". A shadow mask is a color selection electrode in which color selection is accomplished, wholly or partially, by shadowing selected areas of the screen from the electron beams. The typical shadow mask in use today has an approximately spherical contour and is spring-supported on the envelope of the containing tube.

Of the prior art tubes which utilize a tensed color selection electrode, some are of the shadow mask variety. Others, confined largely to the laboratory as of this date, have one or more electrical potentials applied to the color selection electrode, which potential(s) differ from a potential applied to the screen so as to cause the electron beams to be focused and/or deflected from their free-flight path. Color selection in those latter prior art tubes is achieved either totally by the establishment of electrical fields, or partially by electrical fields and partially by mechanical shadowing of the screen.

This invention is applicable to the latter-described class of tubes in which the color selection electrode is tensed in at least one direction.

There exists in the marketplace today a color tube which utilizes a tensed shadow mask. The mask is understood to be placed under high tension by purely mechanical means. Specifically, a very heavy mask support frame is compressed prior to and during affixation of the mask to it. Upon release of the frame, restorative forces in the frame cause the mask to be placed under high residual tension. During normal tube operation, electron beam bombardment causes the mask to heat up and the mask tension to be reduced. An upper limit is placed on the intensity of the electron beams which may be used to bombard the screen without causing the mask to relax completely (buckle) and lose its color selection capability. The upper limit has been found to be below that required to produce color pictures of the same brightness as are produced in tubes having non-tensed shadow masks. For descriptions of examples of this type of tube, see U.S. Pat. No. 3,638,063 and "25-V Inch 114° Trinitron Color Picture Tube and Associated New Developments, BTR," August, 1974, pp 103–200, by Yoshida et al. Also see U.S. Pat. Nos. 3,719,848 and 2,905,845, and "General Electric Post Acceleration Color Tube" by C. T. Lob, *IRE Convention Record, Electron Devices and Receivers,* 1956, pp. 114–117.

It is perhaps more common in the prior art of tensed electrode television tubes to find the electrode being installed by combining mechanical tensioning of the electrode with applied heat. Typically, in such prior art disclosures, a color selection electrode in the form of an apertured foil or a grid of wires is held in a holder which places the electrode under a predetermined amount of tension at room temperature. The electrode and the holder are then heated to a predetermined elevated temperature in an oven. By having selected a material for the electrode which has a coefficient of thermal expansion which is substantially greater than that of the holder, the electrode is caused to expand to a greater degree than the holder.

Typically the holder includes a part of the tube's envelope for ultimately securing the electrode and a temporary fixture for stretching the electrode before attachment of the electrode to the envelope. While at the predetermined elevated temperature, the electrode is sealed to the envelope — e.g. between the faceplate and funnel thereof, or to an interior ledge on the envelope. Upon cool-down of the tube, the electrode contracts to a greater extent than does the envelope, causing the electrode to be placed under high tension.

This approach has the same drawback as the purely mechanical approach — that is, an electrode installed by this method is incapable of absorbing a satisfactorily high electron beam current before it relaxes.

The latter-described prior art approach also suffers from the problem of maintaining the precision of the temporary fixture which goes into the oven with the tube. Examples of this latter approach to installing tensed color selection electrodes can be seen in U.S. Pat. Nos. 3,489,966, 2,842,696, 3,284,655, and 2,813,213, and in British Pat. No. 1,163,495.

OTHER PRIOR ART

U.S. Pat. No. 3,790,845 — Campbell

OBJECTS OF THE INVENTION

It is a general object of this invention to provide an improved method for installing a tensed color selection electrode in a color cathode ray tube.

It is a less general object of the present invention to provide a method for installing a tensed color selection electrode which is capable of absorbing higher electron beam currents before relaxing than is possible following prior art installation methods.

BRIEF DESCRIPTION OF THE DRAWING

The FIGURE schematically illustrates apparatus for assisting in carrying out the method of the present invention.

DESCRIPTION OF THE PREFERRED METHOD

Figure 1:
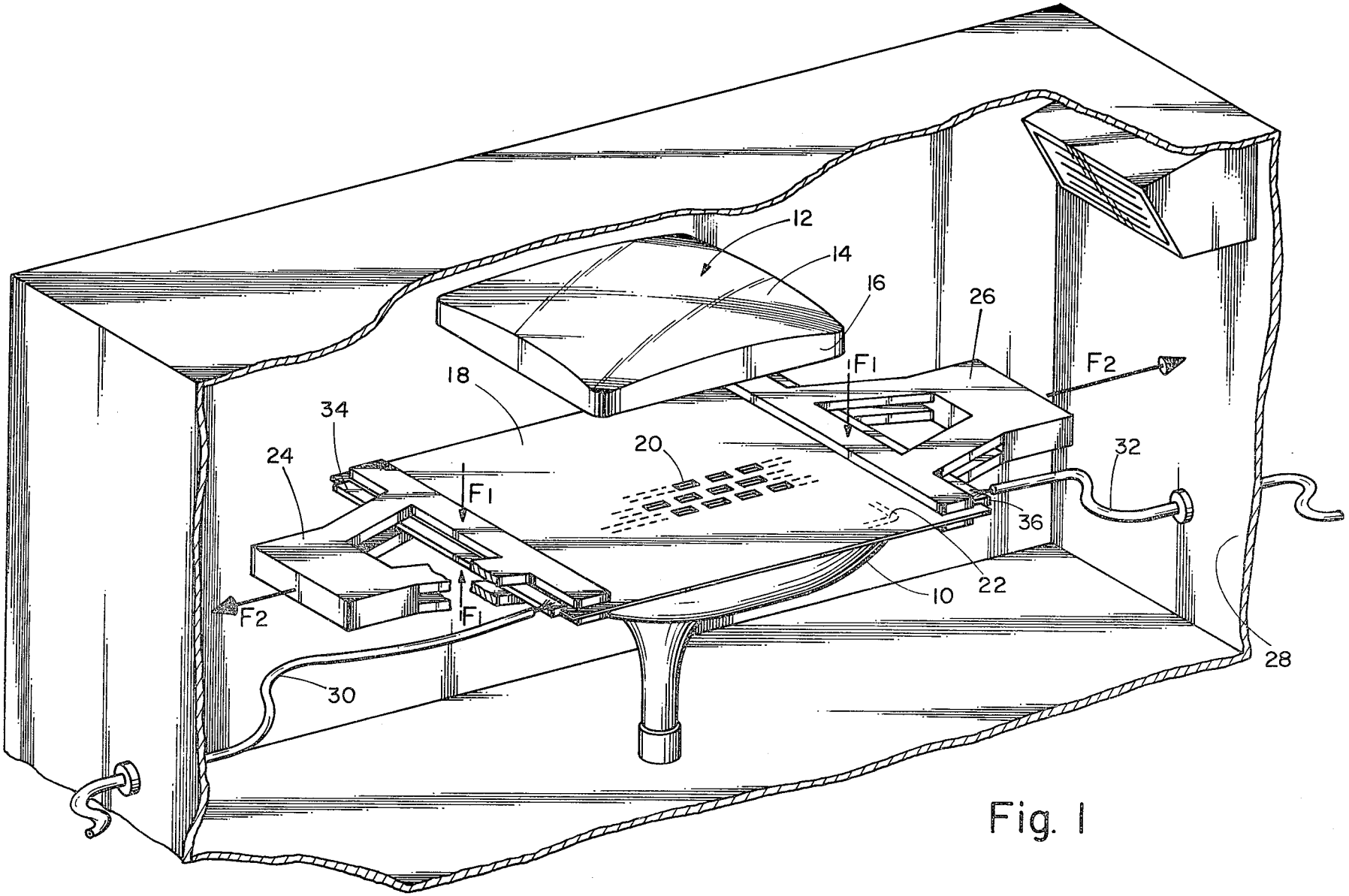

A preferred execution of the method of the present invention will now be described. The FIGURE illustrates, in highly schematic form, a color cathode ray tube in which a color selection electrode is being installed in accordance with my teachings. The cathode ray tube is depicted as comprising a funnel 10 and a faceplate 12. The faceplate 12 has a substantially flat viewing window 14. A rearward flange 16 on the faceplate 12 has a front-to-back depth which is intended to space a color selection electrode 18 sealed between the faceplate 12 and funnel 10, as by means of a devitrifying glass cement or "frit" at an appropriate distance from the inner surface of the viewing window 14.

Whereas the color selection electrode which may be installed according to this invention may take a variety of configurations, in the illustration it is shown as comprising a thin metal foil, preferably about 2–5 mils thick, in which is formed a pattern of electron beam-passing apertures 20.

Before discussing specifics of the present invention, a number of background considerations will be treated. The modulus of elasticity E for steel, the most commonly employed electrode material, is not strictly constant with temperature and to good approximation follows the relationship:

$$E = (28 \times 10^6 - 11 \times 10^3 T) \text{ psi}$$

where $T$ is the electrode temperature in degrees centigrade. Similarly, the yield strength (proportional limit) Y may be approximated by the following expression:

$$Y = (40 \times 10^3 - 36T) \text{ psi}$$

It is instructive to determine the temperature at which the frit-sealed assembly reaches the yield point of the electrode. The stress S in the electrode is $$S = (\epsilon_M - \epsilon_G)(T_F - T) \cdot E$$

where $\epsilon_M$ and $\epsilon_G$ are the thermal expansion coefficients of the electrode and envelope glass respectively, $T_F$ is the frit sealing temperature (say, 430° C) and $T$ is the assembly temperature upon cooling. If $S$ is the yield stress $Y$, we have $$Y = 40 \times 10^3 - 36T = 3 \times 10^{-6}(430 - T)(28 \times 10^6 - 11 \times 10^3 T).$$

The proper root of this quadratic expression is:

$$T = -57° \text{ C}.$$

Hence, so long as the tube is not cooled below −57° C, the electrode will not be stressed beyond its yield point.

Under normal tube operating conditions the electrode will assume some temperature $T_M$, while the envelope is at some lower temperature $T_G$. In this instance, the electrode stress is $$S = (\epsilon_M - \epsilon_G)(T_F) E - \epsilon_M T_M E + \epsilon_G T_G E.$$

Setting $S = 0$, we have an expression for the maximum electrode temperature before buckling occurs:

$$T_M = \frac{(\epsilon_M - \epsilon_G) T_F}{\epsilon_M} + \frac{\epsilon_G T_G}{\epsilon_M}$$

Inserting typical numerical values.

$$T_M = \frac{3 \times 10^{-6} \times 430}{12 \times 10^{-6}} + \frac{9 \times 10^{-6} T_G}{12 \times 10^{-6}}$$

If the envelope temperature is taken as 30° C, the critical electrode temperature is $$T_M = 115° \text{ C}$$

Assuming that all electrode energy is dissipated only by radiation (which leads to a conservative power estimate) the limiting beam power density W is $$W = 2 \times 36.97 \times 0\ 10^{-12} e\,(\bar{T}_M^4 - \bar{T}_G^4) \text{ watts/in}^2.$$

The factor 2 multiplying the Stefan-Boltzmann constant is used because both sides of the electrode radiate. The emissivity $e$ for a properly blackened electrode should be at least 0.9. The screen and funnel emissivity must also be high for proper radiation cooling. The electrode and envelope temperatures should be expressed in degrees Kelvin. Note that the relationship is not dependent on electrode transmission or thickness.

Hence, $$W = 7.39 \times 10^{-11}([115 + 273]^4 - [30 + 273]^4) = 1.05 \text{ w/in}^2$$

Applying this relation to typical commercial 13V receivers operating at 25 kilovolts, an upper limit of sustained peak white beam current of about 3.8ma (all three guns) is set. For 25V receivers operating at 30KV, the limit is approximately 11 ma. Unlike local doming effects in spherical electrodes, a white area displayed on a tensed electrode receiver which does not extend substantially from top to bottom will not readily cause sufficient total electrode expansion to be troublesome.

It should be noted that the power handling capability of the electrode is a fourth power function of the electrode critical temperature. Raising it from 388° K (115° C) to, say, 439° K (166° C) doubles the allowable beam power, thus providing what would appear to be an adequate operating margin.

It is an object of the present invention to teach a method of installing a tensed electrode in a color CRT which significantly increases critical temperatures at which the electrode will buckle or relax. As will be explained in more detail hereinafter, in accordance with one aspect of the method of this invention, the electrode 18 is installed on the color CRT envelope in a hypertensed state.

In the illustrated execution, the electrode 18 is sealed between the funnel 10 and faceplate 12 along a peripheral track — shown in dotted lines in the figure at 22. The material for the electrode 18 is selected preferably to have a significantly higher coefficient of thermal expansion than that of its holder (the holder is here shown as comprising the color CRT envelope). By way of example, the shadow mask may be formed of cold-rolled steel; the color CRT envelope may be composed of any of the standard glass materials used today in the manufacture of color cathode ray tube envelopes. The temperature coefficient of expansion of cold-rolled steel is in the order of $13.5 \times 10^{-6}$ per degree centigrade, whereas the temperature coefficient of expansion of typical color CRT glasses is in the order of $9.0 \times 10^{-6}$ per degree centigrade.

In accordance with this invention the electrode 18 is grasped by a temporary fixture, here shown schematically as taking the form of two clamps 24, 26. Opposed forces $F_1$ exerted by the clamps securely hold opposed sides of the electrode 18. In other applications it may be desirable to use a temporary fixture which stretches the electrode in a second orthogonal direction, or in all radial directions around the azimuth of the tube axis. The electrode 18, holder (the envelope) and fixture are externally heated, as by placing them in an oven 28. The electrode, holder and fixture are heated until all parts reach an equilibrium condition at a first elevated temperature, e.g. 430° C.

The clamps 24, 26 are urged strongly in opposed directions, as by application of opposed forces, $F_2$, causing the electrode to be tensed. While mechanically tensing the electrode and externally heating the electrode and its temporary holding fixture, in accordance with this invention an electrical current is passed through the electrode to cause the electrode to be super-heated to a predetermined second elevated temperature which is significantly greater than the said first elevated temperature — e.g. 460° C. The holder and electrode are thus caused to thermally expand, but the electrode by a greater amount.

In the illustrated execution electrical current is passed through the electrode 18 by means of electrical conductors 30, 32 which are electrically connected to bus bars 34, 36 on the opposite sides of the electrode 18.

While the electrode and holder are at the said different elevated temperatures, the electrode is sealed between the faceplate 12 and funnel 10, i.e. to the holder. This sealing may be accomplished by the use of well known glass-to-metal sealing techniques. (See the above-referenced prior art disclosures.)

The electrode and holder are then cooled to room temperature, causing the electrode to be hypertensed due to the greater coefficient of thermal expansion and temperature fall of the electrode than of the envelope.

By following my method, the ultimate tension in the electrode 18 can be caused to be significantly greater than is possible following prior art tensed-electrode installation processes.

In the described preferred execution of the invention, resistance heating according to this invention is employed along with at least some mechanical tensioning and with external heating. Alternatively, the selective auxiliary heating of the electrode could be accomplished by the use of an RF (radio frequency) heater or other instrumentality capable of heating the electrode to a temperature greater than that of the holder. In certain applications, resistance heating may be utilized as the sole source of thermal energy for heating the electrode. The resultant achievable tension in the end-product electrode may not be as great as where external heat is applied simultaneous with resistance heating of the electrode, nevertheless this latter method offers certain advantages including more efficient use of energy during electrode installation.

Whereas in the described preferred embodiment the electrode is composed of material having a significantly higher thermal coefficient of expansion than that of the holder, it is contemplated that an electrode material could be selected which has a coefficient of expansion about the same as, or only slightly greater than, that of the holder. In such an execution, the electrode would be tensed as a result of the greater temperature fall (upon cool-down) of the electrode than the holder. In such an execution, the electrode would not have the afore-described low temperature limitation.

While particular method of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. In the manufacture of a color cathode ray tube of the type having a phosphor screen and spaced therefrom a color selection electrode, a method of installing the electrode such that under normal tube operating conditions, the electrode is held by a holder in a tensed state and is thus capable of withstanding a high electron beam bombardment before relaxing, said method comprising:

forming the electrode from a material which has a significantly higher coefficient of thermal expansion than that of the holder;

tensing the electrode and simultaneously passing an electrical current through it such that the electrode is heated to a predetermined elevated temperature significantly greater than the temperature of the holder, said electrode thus being caused to thermally expand relative to said holder;

affixing the electrode to the holder; and cooling the electrode and holder to room temperature so as to effect a tensing of the electrode due to greater coefficient of thermal expansion of the electrode than the holder.

2. In the manufacture of a color cathode ray tube of the type having a phosphor screen and spaced therefrom a tensed color selection electrode, a method of installing the electrode such that under normal tube operating conditions, the electrode is held by a holder in a hypertensed state and is thus capable of withstanding an unusually high electron beam bombardment before relaxing, said method comprising:

forming the electrode from a material which has a significantly higher coefficient of thermal expansion than that of the holder;

externally heating the electrode and the holder while tensing the electrode and simultaneously effecting selective auxiliary heating of the electrode such that the holder is heated to a predetermined first elevated temperature and the electrode is heated to a predetemined second elevated temperature significantly greater than said first temperature, said holder and electrode thus being caused to thermally expand, but said electrode by a greater amount;

affixing the electrode to the holder; and cooling the electrode and holder to room temperature so as to hypertense the electrode due to the greater coefficient of thermal expansion and temperature fall of the electrode than the holder.

3. In the manufacture of a color cathode ray tube of the type having a phosphor screen and spaced therefrom a tensed color selection electrode, a method of installing the electrode such that under normal tube operating conditions, the electrode is held by a holder in a hypertensed state and is thus capable of withstanding an unusually high electron beam bombardment before relaxing, said method comprising:

forming the electrode from a material which has a significantly higher coefficient of thermal expansion than that of the holder;

externally heating the electrode and the holder while tensing the electrode and simultaneously passing an electrical current through it such that the holder is heated to a predetermined first elevated temperature and the electrode is heated to a predetermined second elevated temperature significantly greater than said first temperature, said holder and electrode thus being caused to thermally expand, but said electrode by a greater amount;

affixing the electrode to the holder; and cooling the electrode and holder to room temperature so as to hypertense the electrode due to the greater coefficient of thermal expansion and temperature fall of the electrode than the holder.

4. In the manufacture of the color cathode ray tube of the type having a phosphor screen and spaced therefrom a tensed color selection electrode, a method of installing the electrode such that under normal tube operating conditions, the electrode is held by a holder in a hypertensed state and is thus capable of withstanding an unusually high electron beam bombardment before relaxing, said method comprising:

forming the electrode from a material which has a coefficient of thermal expansion which is no less than that of the holder;

externally heating the electrode and the holder while tensing the electrode and simultaneously effecting selective auxiliary heating of the electrode such that the holder is heated to a predetermined first elevated temperature and the electrode is heated to a predetermined second elevated temperature significantly greater than said first temperature, said holder and electrode thus being caused to thermally expand, but said electrode by a greater amount;

affixing the electrode to the holder; and cooling the electrode and holder to room temperature so as to tense the electrode due at least to the greater temperature fall of the electrode than the holder.

* * * * *